US007371114B2

(12) United States Patent
Tanaka

(10) Patent No.: US 7,371,114 B2
(45) Date of Patent: May 13, 2008

(54) RESILIENT PLUG AND A WATERTIGHT CONNECTOR

(75) Inventor: Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/602,035

(22) Filed: Nov. 20, 2006

(65) Prior Publication Data

US 2007/0117441 A1 May 24, 2007

(30) Foreign Application Priority Data

Nov. 24, 2005 (JP) ..... 2005-338879

(51) Int. Cl.
*H01R 13/40* (2006.01)

(52) U.S. Cl. ..... 439/587; 439/275

(58) Field of Classification Search ..... 439/271–275, 439/587

See application file for complete search history.

(56) References Cited

U.S. PATENT DOCUMENTS 4,643,506 A * 2/1987 Kobler ..... 439/271
5,662,336 A * 9/1997 Hayashi et al. ..... 439/275
5,667,406 A * 9/1997 Tabata et al. ..... 439/587
6,325,661 B1 * 12/2001 Tabata ..... 439/587

FOREIGN PATENT DOCUMENTS

EP 0 817 330 A1 1/1998
JP 2002-280108 9/2002

* cited by examiner

*Primary Examiner*—Briggitte R. Hammond
(74) *Attorney, Agent, or Firm*—Gerald E. Hespos; Anthony J. Casella

(57) ABSTRACT

A rubber plug (8) has a tubular main portion (8A) and a wire inserting hole (5) penetrates the main portion (8A) along a central axis (C) for receiving a wire (W). The main portion (8A) includes an inner lip portion (13) and an outer lip portion (14) having lips (12) circumferentially formed on the inner and outer circumferential surfaces of the main portion (8A). A tapered entanglement preventing portion (8B) extends from an opening edge (17) of the wire insertion hole (5) to a rear peripheral edge (13A) of the outer lip portion (13). Another wire (W) slides on the tapered surface (16) to avoid entanglement.

2 Claims, 5 Drawing Sheets

RESILIENT PLUG AND A WATERTIGHT CONNECTOR

BACKGROUND OF THE INVENTION

1. Field of the Invention

The invention relates to a resilient plug and to a watertight connector.

2. Description of the Related Art

Japanese Unexamined Patent Publication No. 2002-280108 discloses a rubber plug that can be mounted over a wire. A terminal fitting then is crimped into engagement with the wire and the rubber plug. The assembly of the terminal fitting, the rubber plug and the wire then is inserted into a cavity of a connector housing. As a result, the rubber plug is squeezed between an inner peripheral surface of the cavity and an outer peripheral surface of the wire to prevent water from entering into the cavity. Assemblies of the terminal fittings, the rubber plugs and the wires are bundled together prior to insertion into the cavities, as shown in FIG. 6. However, a wire W4 that is pulled from the bundle of wires shown in FIG. 6 is likely to get caught by a wire W3 connected with another terminal fitting because the rear end of a rubber plug 108 is upright. This entanglement of the wires W3, W4 creates problems and reduces operational efficiency.

The invention was developed in view of the above problem and an object thereof is to prevent wires from getting entangled with each other upon pulling out a wire in a terminal inserting process.

SUMMARY OF THE INVENTION

The invention relates to a resilient plug with a tubular main portion. A wire inserting hole penetrates the main portion along a central axis of the main portion and is dimensioned to receive a wire. At least one outer lip is formed to extend circumferentially around at least part of the outer circumferential surface of the main portion. An entanglement preventing portion projects back from the rear end of the main portion and has a tapered, converging arcuate or bent surface that extends from a rear surface at the rear end of the wire inserting hole towards a rear peripheral edge of the outer lip on the outer circumferential surface. Thus, a wire that is being pulled from a bundle of wires will slide on the tapered, converging, arcuate or bent surface to avoid entanglement.

The resilient plug also preferably includes at least one inner lip that extends circumferentially at least partly around the inner circumferential surface of the main portion.

The rear surface at the rear end of the wire inserting hole preferably extends substantially upright with respect to the central axis of the main portion. A distance from the outer peripheral edge of the rear surface to the outer circumferential surface of the wire along a radial direction preferably is less than the radius of the wire. Thus, even if another wire touches the opening edge surface, the central axis of the wire is radially outward of the outer peripheral edge of the upright rear surface. Therefore, the wire can move easily onto the slanted or arcuate surface, and the wires will not be entangled.

At least part of the rear surface preferably is widened to form a guiding surface.

The invention also relates to watertight connector and at least one of the above-described resilient plugs. The connector includes a housing and at least one cavity penetrates the housing in substantially forward and backward directions. A wire is inserted through the wire inserting hole of the resilient plug, and a terminal fitting is fastened to the resilient plug and the wire. The terminal fitting, the plug and the wire then are inserted into the cavity. As a result, the resilient plug is squeezed resiliently between the inner surface of the cavity and the outer circumferential surface of the wire.

The entanglement preventing portion preferably projects at least partly from the rear end of the cavity. Thus, even if the wire is shaken, the influence of deformation does not go beyond the entanglement preventing portion and the lips are not deformed. Therefore, the lips can be held in close contact with the inner wall of the cavity and the wire, enabling a watertight function to be maintained.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
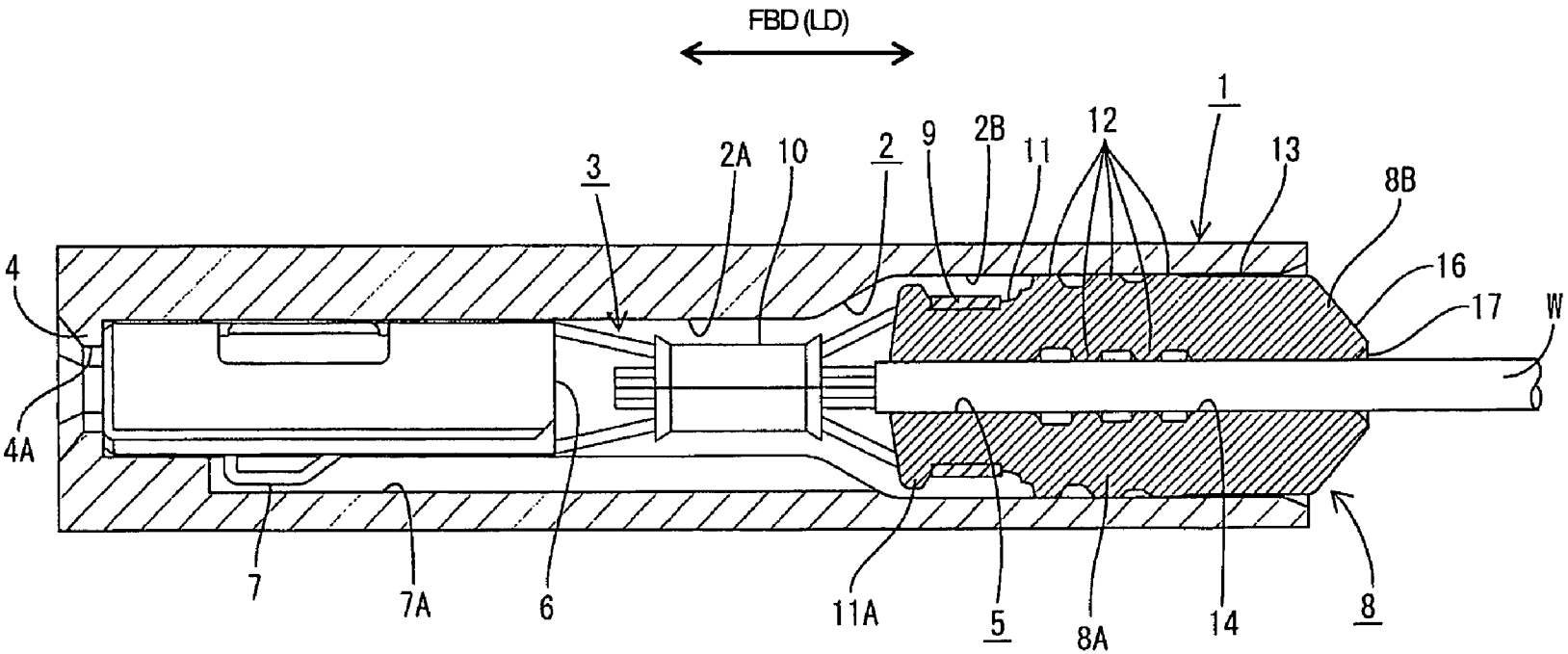
FIG. 1 is a side view partly in section of a watertight connector according to a first embodiment.
Figure 2:
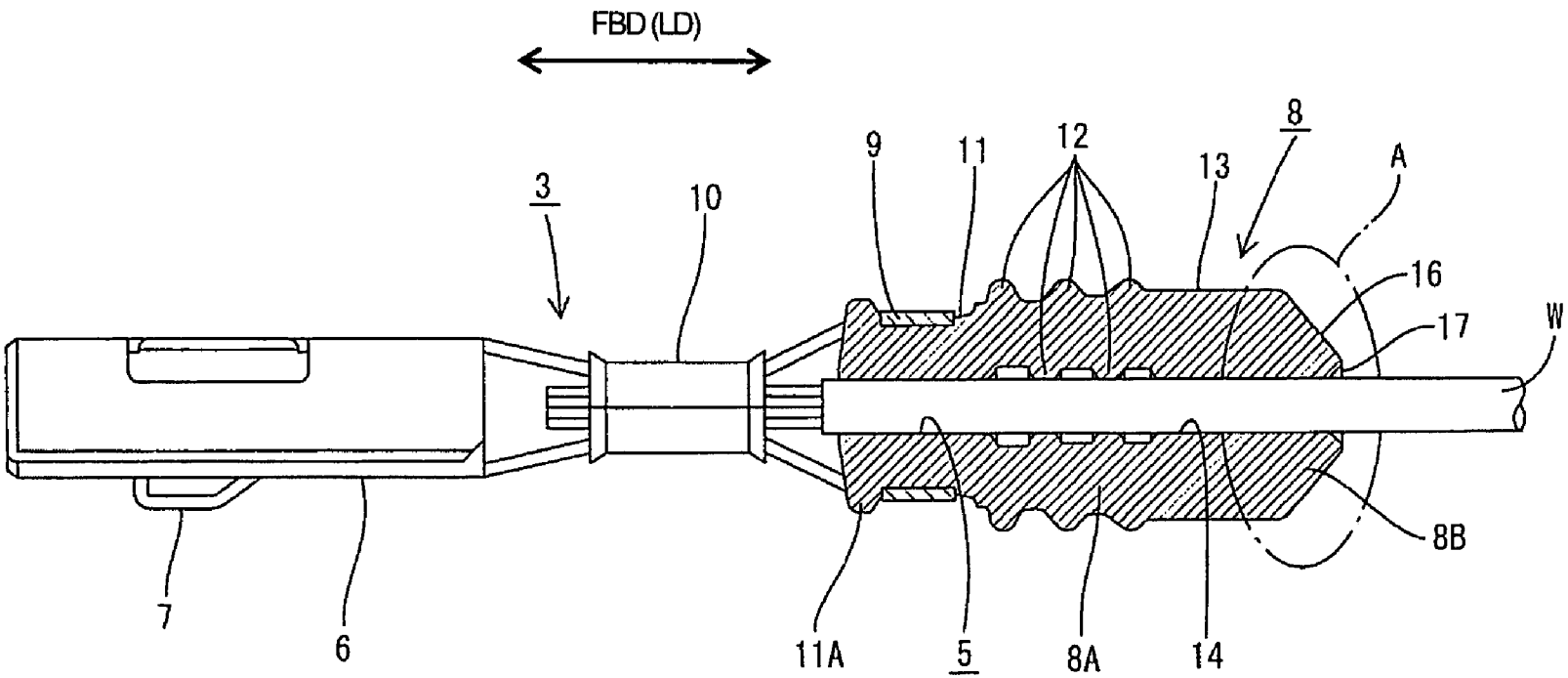
FIG. 2 is a side view partly in section showing a state before a terminal fitting connected with a resilient or rubber plug is at least partly inserted into a cavity.

A watertight connector according to a first embodiment of the invention is described with reference to FIGS. 1 to 4. The connector has a housing 1 and at least one cavity 2 penetrates the housing 1 in forward and backward directions FBD. A terminal accommodating hole 2A is defined at a front part of the cavity 2 and a substantially cylindrical plug-mounting hole 2B is defined at a rear part of the cavity 2. A terminal fitting 3 can be inserted into the cavity 2 from behind, as shown in FIG. 1. The terminal fitting 3 is stopped at a frontmost position by a front wall 4 of the cavity 2, and is prevented from coming out backward by a lock (not shown) in the cavity 2. A substantially rectangular tube 6 is formed at the front of the terminal fitting 3 and is accommodated in the terminal accommodating hole 2A. A plug 8, of rubber or other resilient material, is mounted on a rear part of the terminal fitting 3 and is accommodated in the plug mounting hole 2B. The front wall 4 is formed with a male-tab insertion hole 4A for receiving a male tab (not shown) of a mating housing.

The terminal fitting 3 is elongated in forward and backward directions FBD, and is formed by punching, stamping or cutting a conductive metal sheet and bending, folding and/or embossing the sheet. As shown in FIG. 1, a substantially rectangular tubular main portion 6 is formed at the front of the terminal fitting 3. An insulation barrel 9 is at the rear of the terminal fitting 3 and is configured to be crimped, bent or folded into connection with both an insulation coating of a wire W and the plug 8. A wire barrel 10 is between the main portion 6 and the insulation barrel 9 and is configured to be crimped, bent or folded into connection with a core or conductor of the wire W. A stabilizer 7 is embossed to project sideways from the rectangular tubular main portion 6. On the other hand, a guiding recess 7A is recessed on an inner wall of the cavity 2 and faces the stabilizer 7 when the terminal fitting 3 is inserted into the cavity 2 from behind. The guiding recess 7A extends in forward and backward directions FBD from the rear end of the terminal accommodating hole 2A to the vicinity of the front end thereof in the cavity 2. Thus, the stabilizer 7 can enter the guiding recess 7A only when the terminal fitting 3 is in a proper posture, thereby preventing an erroneous insertion.

The plug 8 is made of a resilient material, for example, silicon, and has a substantially cylindrical shape. More particularly, the plug 8 has a main portion 8A to be accommodated in the cavity 2 and an entanglement preventing portion 8B projects back from the rear end of the main portion 8A. The entanglement preventing portion 8B projects back from the cavity 2. A wire insertion hole 5 penetrates the plug 8 substantially along a central axis LD, and the insulation coating at an end of the wire W can be inserted through the wire insertion hole 5 to mount the plug 8 on the wire W. A fastening portion 11 is defined by the outer circumferential surface of a front part of the main portion 8A, and the insulation barrel 9 is wound or folded at least partly around the fastening portion 11 to fasten the terminal fitting 3 to the plug 8. A retaining flange 11A projects circumferentially from the outer circumferential surface of the front end of the fastening portion 11 to reinforce the fastening to the insulation barrel 9.

Circumferentially extending lips 12 project radially out from an outer lip portion 13 and in from an inner lip portion 14 at positions behind the fastening portion 11. The lips 12 are spaced apart in forward and backward directions FBD. The outer lip portion 13 closely contacts the inner circumferential surface of the plug mounting hole 2B and the inner lip portion 14 closely contacts the outer circumferential surface of the wire W when the plug 8 is inserted into the cavity 2, thereby preventing the entrance of fluid or water into the cavity 2 through the plug mounting hole 2B.

Figure 3:
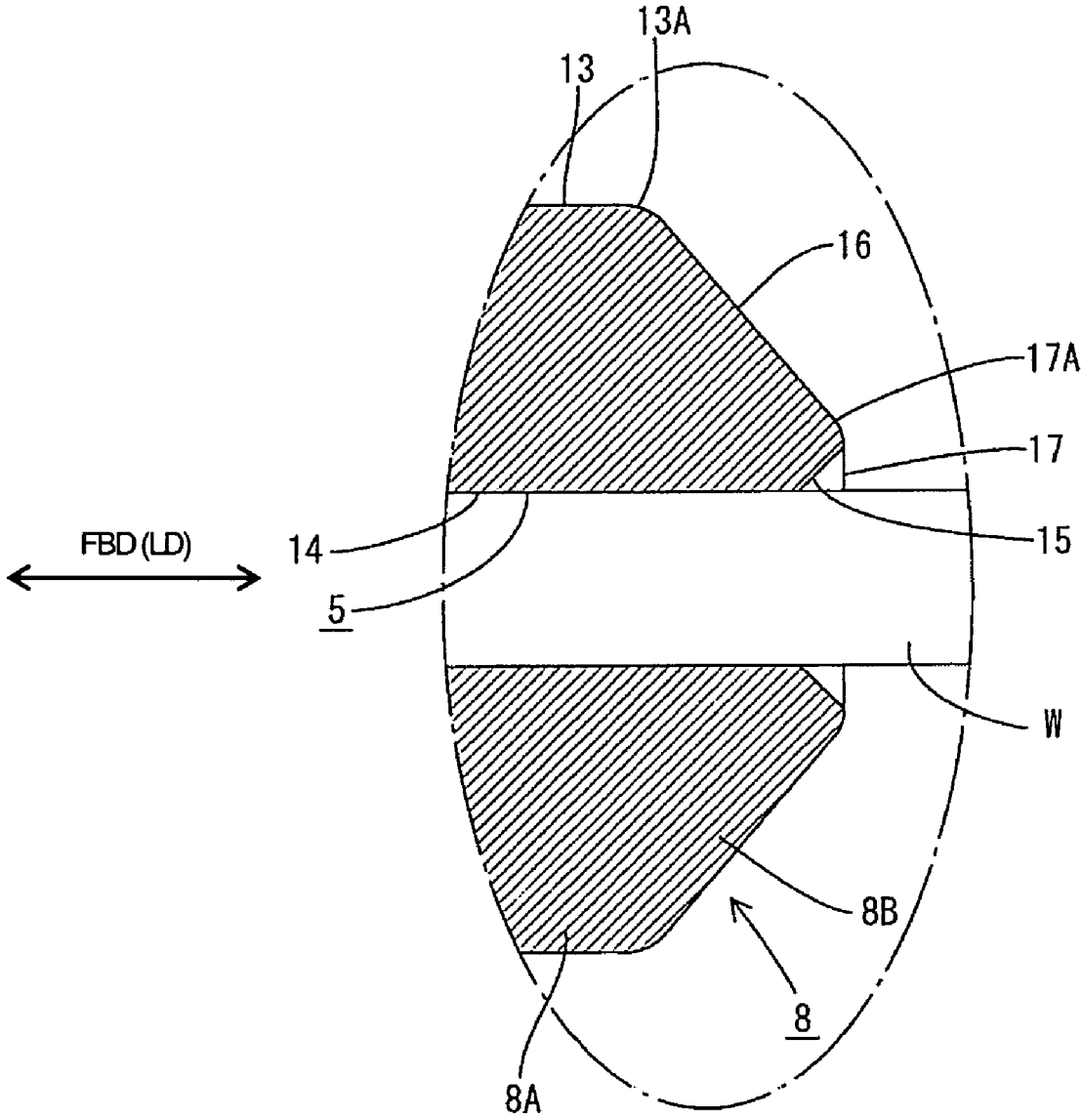
FIG. 3 is an enlarged view showing a portion A of FIG. 2.

FIG. 3 is an enlarged view of the entanglement preventing portion 8B. An opening 17 at the rear end of the wire insertion hole 5 is widened to form a guiding surface 15 for guiding the wire W into the wire inserting hole 5. On the other hand, a tapered surface 16 is formed from an outer peripheral edge 17A of the opening 17 to a rear peripheral edge 13A of the outer lip portion 13. Further, a distance between the outer peripheral edge 17A of the opening 17 to the outer surface of the wire W along a radial direction is less than the radius of the wire W. A boundary between the outer lip portion 13 and the tapered surface 16 projects out from the rear end of the cavity 2, as shown in FIG. 1.

Figure 4:
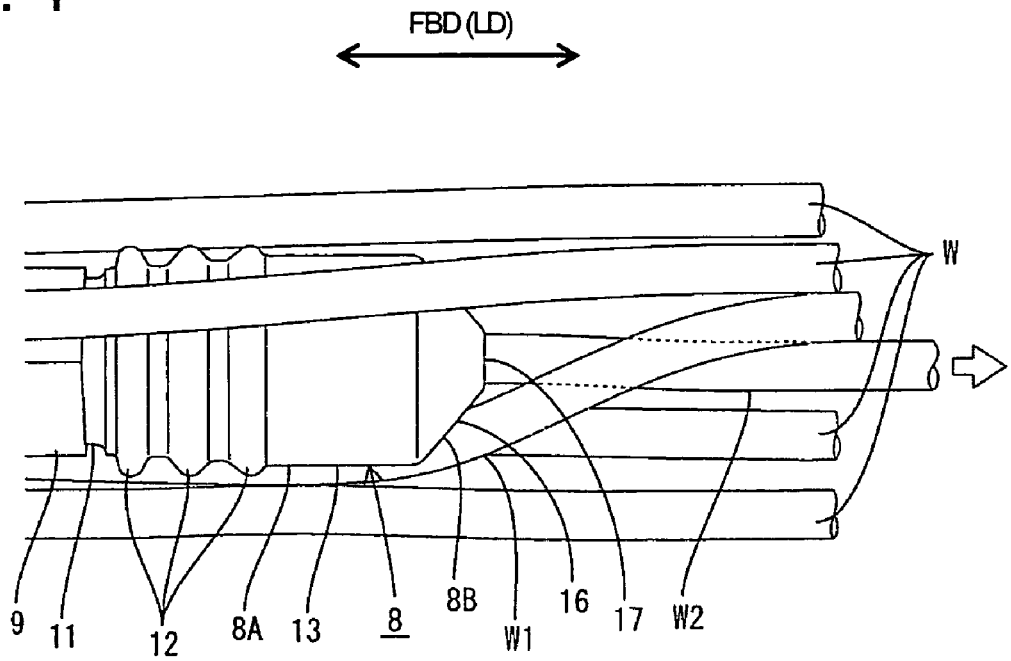
FIG. 4 is a schematic view showing a wire connected with the rubber plug of the first embodiment being pulled out from a bundle of wires.

The terminal fittings 3 are crimped, bent or folded into connection with the plugs 8 and the wires W to form assemblies that are bundled. The wires W of the assembly are pulled out one by one to be inserted into the cavities 2 of the housings 1. However, as shown in FIG. 4, the terminal fitting 3 on the wire W1 may touch the tapered surface 16 of the plug 8 on the wire W2 as the wire W2 is pulled from the bundle of the wires W. In such a case, the wire W1 slides on the tapered surface 16 while receiving an outwardly acting escaping force from the tapered surface 16. Accordingly, the plug 8 and the terminal fitting 3 can move while thrusting themselves through the bundle of the wires W by the tapered surface 16 to prevent entanglement of the wires W.

As described above, the entanglement preventing portion 8B has the tapered surface 16 from the opening 17 at the rear end of the wire inserting hole 5 towards the rear peripheral edge 13A of the outer lip portion 13. Thus, even if another wire W touches upon pulling the wire W from the bundle of the wires, this wire W slides on the tapered surface 16, thereby avoiding entanglement. Further, the entanglement preventing portion 8B projects from the rear end of the cavity 2, even if the wire W is shaken. Thus, the influence of deformation does not go substantially beyond the entanglement preventing portion 8B and the lip portions 13, 14 are not deformed. Therefore, the lips 12 are held in close contact with the inner wall of the cavity 2 and the wire W, enabling a fluid- or watertight function to be maintained.

Figure 5:
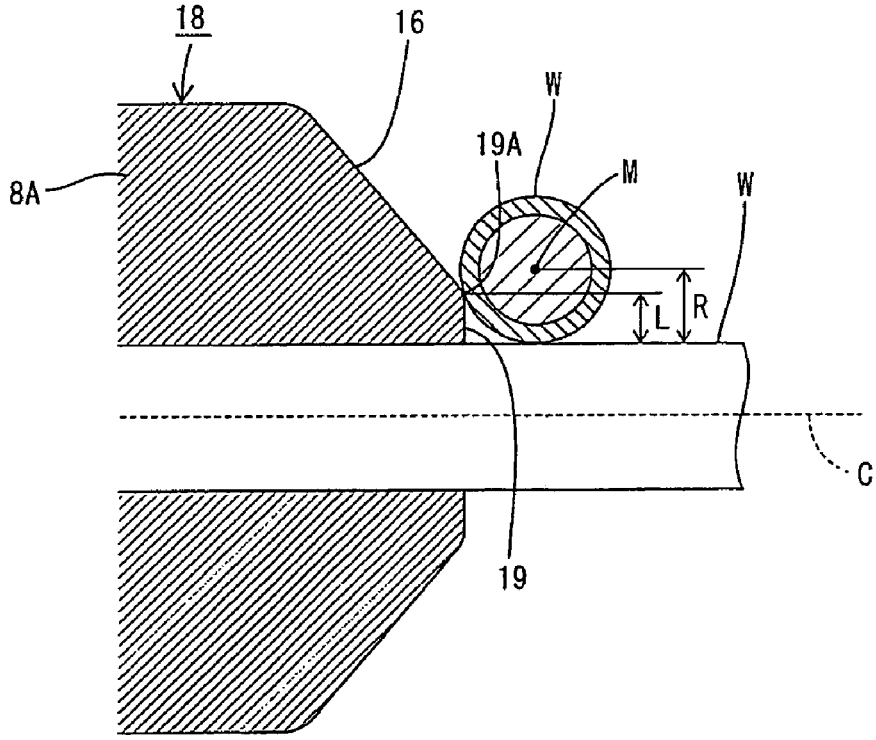
FIG. 5 is an enlarged view showing an entanglement preventing portion according to a second embodiment.
Figure 6:
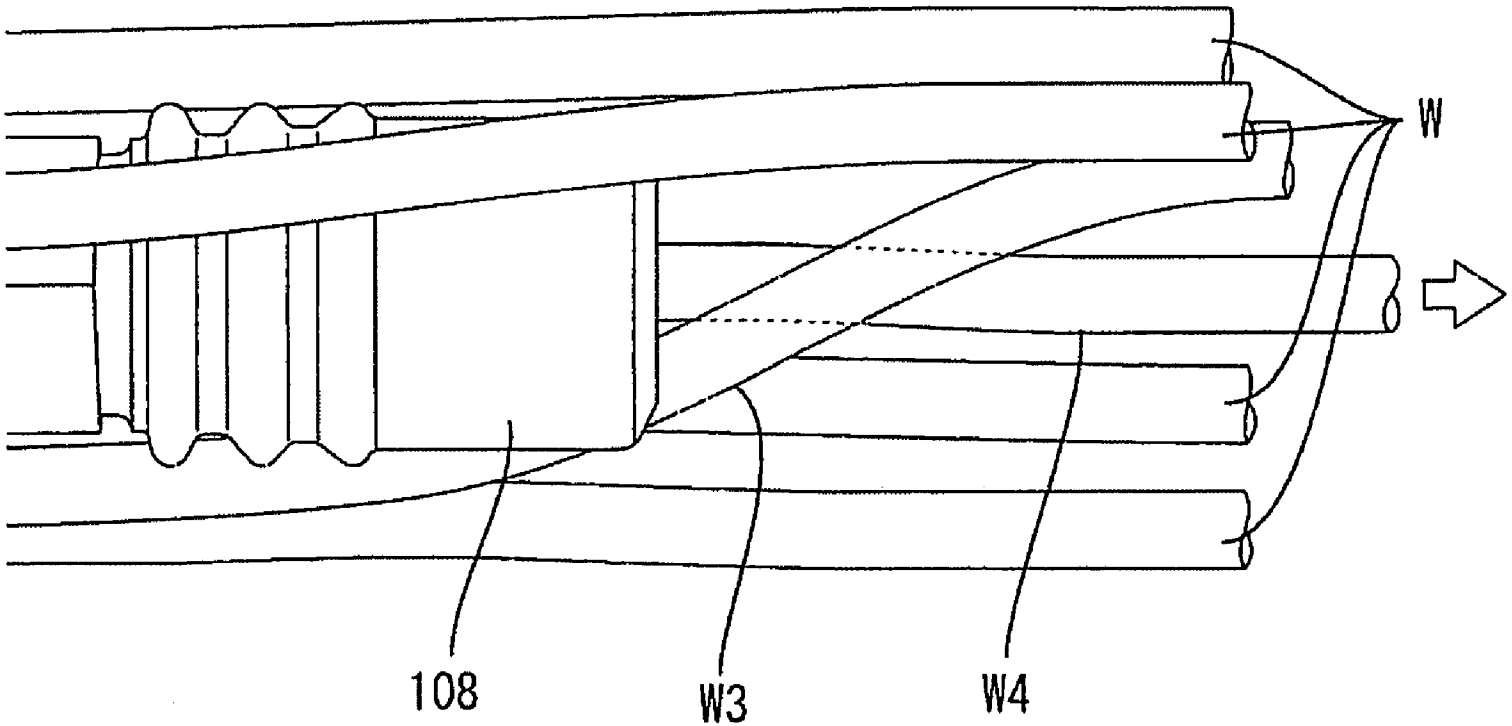
FIG. 6 PRIOR ART
FIG. 6 is a schematic view showing a state where a wire connected with a rubber plug according to a prior art is pulled out from a bundle of wires.

A second embodiment of the invention is described with reference to FIG. 5. A resilient or rubber plug 18 of this embodiment differs from the plug 8 of the first embodiment in that the opening 17 is changed. Other similar or repeating structure is not described. Specifically, the opening of this embodiment is a radial surface 19 with respect to a central axis C of a main portion 8A of the plug 18, and a distance L from an outer peripheral edge 19A of the radial surface 19 to the outer circumferential surface of a wire W in a radially inward direction is less than a radius R of the wire W. As a result, even if the wire W touches the opening edge portion 19, a central axis M of the wire W is radially outward of the outer peripheral edge 19A of the radial surface 19. Therefore, the wire W can easily move onto a tapered surface 16, with the result that the entanglement of the wires W can be prevented.

The invention is not limited to the above described and illustrated embodiments. For example, the following embodiment is also embraced by the technical scope of the present invention as defined by the claims. Beside the following embodiment, various changes can be made without departing from the scope and spirit of the present invention as defined by the claims.

Although the entanglement preventing portion 8B is formed with the tapered surface 16 in the foregoing embodiments, an arcuate or rounded surface having arcuate oblique sides in cross section may be formed according to the present invention.

What is claimed is:

1. A watertight connector, comprising;

a housing, at least one cavity penetrating the housing in substantially forward and backward directions;

a resilient plug having opposite front and rear ends, a wire inserting hole penetrating the resilient plug along a central axis extending from the rear end to the front end, the wire inserting hole being configured for receiving a wire having a selected radius, the resilient plug including a main portion forward of the rear end, the main portion having an outer circumferential surface, at least one outer lip extending circumferentially around at least part of the outer circumferential surface of the main portion, a rear opening surface surrounding the wire inserting hole at the rear end of the resilient plug, the rear opening surface being aligned substantially normal to the center axis of the resilient plug and defining a selected radial dimension from an outer peripheral edge of the rear opening surface to the wire inserting hole, an entanglement preventing portion projecting back from the main portion, the entanglement preventing portion having a tapered surface extending substantially from the rear opening surface towards the outer peripheral surface of the main portion;

at least one wire inserted through the wire inserting hole of the resilient plug, the wire having a radius that exceeds the radial dimension of the rear opening surface; and a terminal fitting fastened together with the wire and the resilient plug the resilient plug being squeezed resiliently between an inner surface of the cavity and an outer circumferential surface of the wire, whereby the tapered surface of the entanglement preventing portion and radial dimensions of the wire and the rear opening surface prevent wires from being entangled with the resilient plug.

2. The watertight connector of claim 1, wherein at least part of the entanglement preventing portion projects from a rear end of the cavity.

* * * * *